US005626156A

United States Patent [19]

Vicory, Sr.

[11] Patent Number: 5,626,156

[45] Date of Patent: May 6, 1997

[54] HAIR STYLING SYSTEM

[76] Inventor: Gary L. Vicory, Sr., 2162 E. Sesame St., Tempe, Ariz. 85283

[21] Appl. No.: 427,127

[22] Filed: Apr. 24, 1995

[51] Int. Cl.[6] ..... A45D 1/04; A45D 2/36; A45D 4/00

[52] U.S. Cl. ..... 132/229; 132/230; 132/261; 132/271; 132/250

[58] Field of Search ..... 132/229, 230, 132/235, 252, 268, 271, 118, 233, 212, 250; 219/222, 226, 227, 230, 530, 540; 34/96, 97, 101

[56] References Cited

U.S. PATENT DOCUMENTS

| | | | |
|---|---|---|---|
| 2,783,763 | 3/1957 | King . | |
| 2,847,015 | 8/1958 | Davis | 132/250 |
| 3,990,460 | 11/1976 | Shalvoy . | |
| 4,249,550 | 2/1981 | Cassidy . | |
| 4,258,732 | 3/1981 | Mariani . | |
| 4,284,091 | 8/1981 | Ehmann . | |
| 4,430,808 | 2/1984 | Toyomi | 34/101 |
| 4,538,362 | 9/1985 | Andis | 34/101 |
| 4,548,218 | 10/1985 | Glucksman . | |
| 4,829,155 | 5/1989 | Fukutuka . | |
| 5,091,630 | 2/1992 | Djuric . | |
| 5,215,107 | 6/1993 | Divner | 132/250 |

*Primary Examiner*—Gene Mancene
*Assistant Examiner*—Pedro Philogene
*Attorney, Agent, or Firm*—LaValle D. Ptak

[57] ABSTRACT

A hair styling system for use with a forced air electric hair dryer constitutes a coupler having a tubular section for receiving the end of an electric hair dryer. This section supports a smaller axially aligned concentric tubular section, with the two sections attached to one another by angularly disposed spacers. Apertures between the spacers permit air to flow over the outside of the smaller tubular section of the coupler. The unattached end of the smaller tubular section extends beyond the larger section and is tapered inwardly toward its central axis. Additional parts of the system include elongated hollow tubular bodies which are closed at one end and open at the other. The open end has an outwardly flared nozzle receiving flange for fitting over the tapered nozzle from the smaller tubular section of the coupler. The tubular bodies have spaced apertures through them at predetermined intervals along their length and about their periphery. Some tubular bodies have a number of spaced circular tapered fins extending radially outwardly from the body. Others of the tubular bodies have an elongated tapered helical fin extending radially outwardly from the bodies along the length.

21 Claims, 2 Drawing Sheets

HAIR STYLING SYSTEM

BACKGROUND

Wave rods for hair curlers have been used for many years to create different hair curling styles. Typically, different types of curlets or rods are used to style or restyle hair, produce permanents, or color the hair. Most styled configurations are imparted by moistening the hair and wrapping it around a rod or curler and applying different waving lotions or setting lotions to the hair to impart a "permanent" wave or curl to it. Many such curlets or wave rods are of a generally cylindrical shape and employ various apertures and projections on the surface Go engage the hair, which is rolled over the cylinder while the hair is wound around the cylinder. Typically, the hair is wound over the rod or curler from the bottom or free end toward the scalp. Once the hair has been wound, clips or rubber bands are used to hold the curler in place for the length of time required for the operation being undertaken.

The rods or curlers which are used typically are provided with different external diameters, depending upon the tightness of the curl which is being formed; so that rods of different diameters are used for different styling effects. Rods of different sizes may be used on different parts of the hair, depending upon the particular look which the hair stylist desires to achieve.

When rods or curlers are used with a permanent waving solution, it is important to carefully determine the amount of fluid which is injected into placed on the hair to avoid damaging the hair. For permanents, it also has been common to wrap strips of cloth over some or part of the hair to absorb excess solution. In addition, it is necessary to ensure that excess solution, which might flow down from rods located along the sides and back of the head, does not collect on the ends of the hair located on the bottom of the rods.

Another problem which has existed in the past is that for permanents and wet styling, drying of the hair with the rods or curlers in place is time consuming. This is particularly true when thick curls, formed by relatively thick or heavy layers or strands of hair, are employed. Those portions of the hair strands which are located adjacent the rod surface remain damp for a considerable time, even after the outside hair has become dry or nearly dry.

Attempts have been made to overcome some of the problems of the prior art devices noted above. The U.S. patent to Cassidy U.S. Pat. No. 4,249,550 is directed to a wave rod designed to form tight curls in hair. The rod is hollow and has a thin helical fin extending radially along its length to form a generally flat-bottomed channel between adjacent turns. Holes are formed in the bottoms of the channels to allow the passing of setting lotion or hair styling liquid from the hair into the interior of the rod. Without the holes, such liquid would accumulate in the bottom of the channels. After a strand of hair has been wound about the rod of the Cassidy patent, a band is stretched across the end nearest the scalp to hold that end in place. After the strand has been wound through the channel, a spring clip is placed over the opposite end to hold the strand in position. The use of the separate bands and clips causes extra time to be consumed in holding the hair strand in place. Drying of the hair, using the device of Cassidy, is accomplished in the same manner as in the prior art, namely from the outer or outside surface only.

The U.S. patent to Djuric U.S. Pat. No. 5,091,630 is directed to a hair curling apparatus which is mounted to a forced hot air dryer. The device of this patent is an elongated hollow rod, which has a number of projections extending outwardly from it for engaging hair wound about the rod. The rod is fitted into an adapter placed over the end of a conventional hair dryer. Holes are placed throughout the length and periphery of the rod to permit air from the dryer, forced into the interior of the rod, to exit through the holes, and therefore through the hair wound on the rod. Consequently, drying of the hair, using this device, is from the inside out, rather than from the outside in, as with the device of Cassidy and other devices of the prior art. Internal vanes are provided inside the rod to impart rotation to the hair curling sleeve to facilitate winding of hair on the curler as air is forced into the curler rod from the hair dryer.

A somewhat different attempt to provide a drying hair curler is disclosed in the U.S. patent to Shalvoy U.S. Pat. No. 3,990,460. The device of the Shalvoy patent is a hollow elongated rod, which has raised projections about it to assist in holding hair on the rod. Apertures or holes are formed throughout the length of the rod around its periphery, and an adapter end is made to fit over the end of hand-held hair dryer. The adapter directs some of the air from the dryer into the interior of the rod; so that it exits through the holes into the hair around the rod. Thus, this device operates to dry hair from the inside out as with the device of the Djuric patent. In addition, the adapter on the end of the hair dryer also directs some of the air axially outwardly along the outer surface of the rod to facilitate drying of the hair on the outside of the rod. Consequently, this device may be considered to provide both radial and axial hot air flow through the hair and over the hair to facilitate drying of the hair. The diverter end of the rod, which is placed over the hair dryer, is integrally formed with the portion about which the hair is wound; and only a single shape or configuration is provided for the rod. There is no disclosure in this patent of any particular manner in which the hair is wound about the curler rod. It appears, however, that it is intended for winding the hair from the bottom or free end upwardly toward the scalp. Nothing is disclosed for holding the curler rod in place.

Many solid or hollow hair styling rods, without any provision for passing hot air outwardly through the rods into the hair, have been designed. A typical spirally shaped hair roller is disclosed in the U.S. patent to Mariani U.S. Pat. No. 4,258,732. The device of this patent is designed to curl and set hair on the spiral rod, with the hair being wound beginning from the roots and ending at the tips. A cylindrical sheath is used to rotate the lock of hair into the spiral, and it is slid in place over the wound hair to hold the hair in place. The sheath has holes or slits in it to permit the passage and penetration of liquids for curling and setting the hair and to effect the drying operation. This is a relatively cumbersome device to use and apply. The sheath also tends to inhibit efficient drying of the hair.

A different approach for drying the hair from within on a hair curler is disclosed in the U.S. patent to Fukutuka U.S. Pat. No. 4,829,155. this patent discloses a tubular member, which holds a charge of working fluid vaporizable at an operating temperature of 50° C. to 70° C. The outer surface of the heat dissipating portion of the member is covered with an elastic hair engagement part to inhibit hair slippage. A heat receiving end portion of the device is exposed so that it can receive heat from a separate external heat source to cause vaporization of the working fluid. Consequently, the hair wound around the outer surface of the heat dissipating portion of the member is heated by the condensation of the vaporized working fluid within the member. The overall operation of the device is comparable of a conventional curling iron; although separate curlers may be utilized simultaneously, in different parts of the hair. The devices of Fukatuka are expensive, because of the multiple types of materials which are required for the curler and because of the sealed tubular member filled with a charge of working fluid necessary to effect the heat transfer.

It is desirable to provide a hair styling system which overcomes the disadvantages of the prior art, which is inexpensive and simple to use, which increases the efficiency of the hair stylist, and which may be used to style, restyle, perm or color hair with the same system.

SUMMARY OF THE INVENTION

It is an object of this invention to provide an improved hair styling system.

It is another object of this invention to provide an improved hair styling system which facilitates a variety of styling applications.

It is an additional object of this invention to provide an improved hair styling system which uses simple and inexpensive elements, and which may be used to style wet, damp or dry hair.

It is a further object of this invention to provide an improved hair styling system which facilitates the drying of wet hair through internal air flow through the hair, as well as over the top of the hair.

In accordance with a preferred embodiment of the invention, a hair styling system is designed for use with a forced air electric hair dryer. An adapter is provided with an enlarged cylindrical portion designed to fit over the end of a hair dryer. This enlarged portion supports an axially aligned concentric smaller tubular section by means of spaced, angled vanes or spacers. The smaller section is tapered to fit into the ends of open tubular bodies, about which hair may be wound. The tubular bodies of the system on which the hair is wound are open at one end and hollow at the other. The open end is designed to mate with the end of the smaller tubular section of the adapter; and the opposite end is closed. Spaced circular fins or a helical fin are used on the hollow tubular bodies to facilitate the winding of hair on the bodies. The spaces on the tubular bodies between the fins are provided with apertures, through which air directed into the open end of the hollow tubular bodies exits to pass through the hair. The support spacers on the adapter cause air to be directed over the outside of hair wound about the hollow tubular bodies in a spiral pattern to create a convection air effect for rapid drying of the hair.

DETAILED DESCRIPTION OF THE PREFERRED EMBODIMENT

Figure 1:
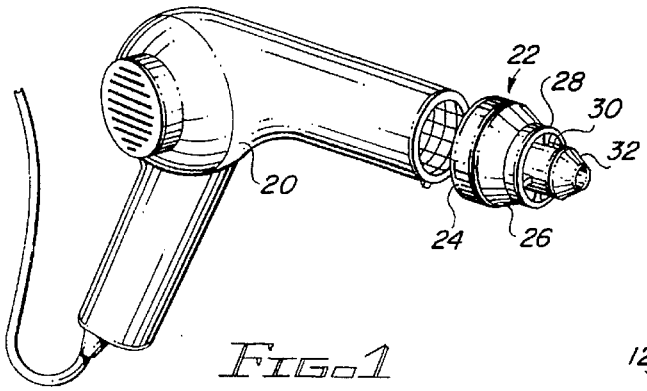
FIG. 1 is a perspective view of a hair dryer showing the manner in which a portion of the preferred embodiment of the invention is used with it.
Figure 2:
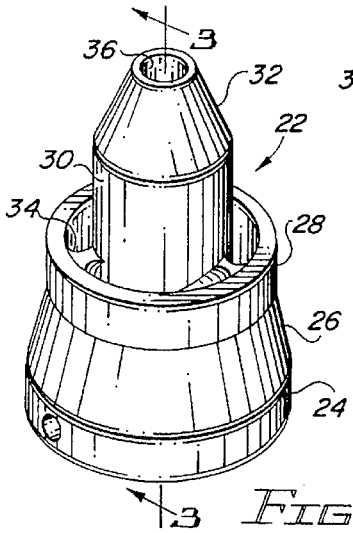
FIG. 2 is an enlarged perspective view of the portion of the embodiment shown in FIG. 1.
Figure 3:
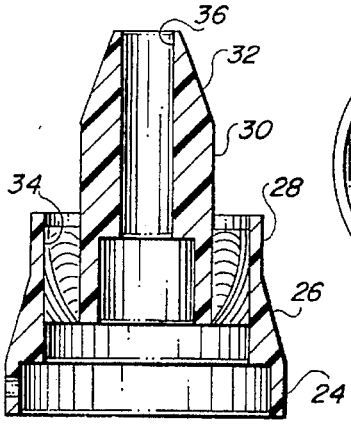
FIG. 3 is a cross-sectional view taken along the line 3—3 of the device shown in FIG. 2.
Figure 4:
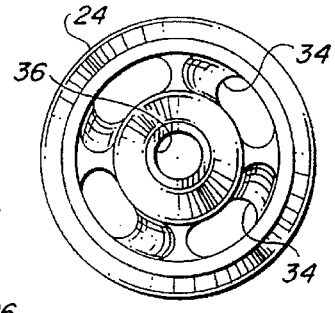
FIG. 4 is a top view of the device shown in FIG. 2.
Figure 5:
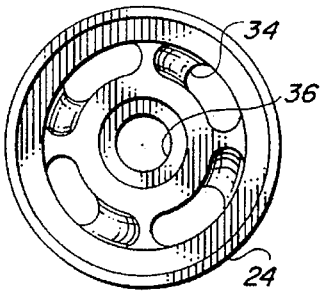
FIG. 5 is a bottom view of the device shown in FIG. 2.
Figure 6:
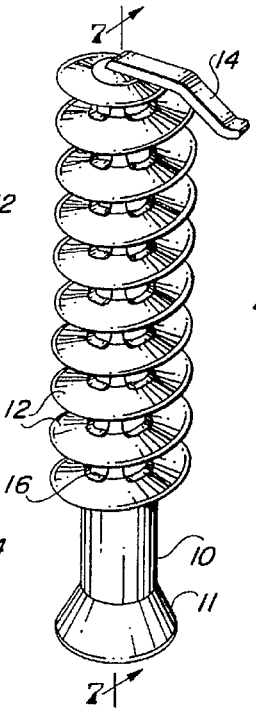
FIG. 6 is a perspective view of a spiral rod used in the preferred embodiment of the invention.

Reference now should be made to the drawing, in which the same reference numbers are used throughout the different figures to designate the same components.

FIG. 1 shows a conventional, hand-held forced-air electric hair dryer 20, with which the hair styling system of the preferred embodiment of the invention is used. FIGS. 6 through 9, 16, 17 and 19 are directed to a hair curler in the form of a spiral designer made in accordance with the preferred embodiment of the invention. This curler comprises a hollow plastic tubular body or core 10, which has an outwardly flared flange 11 on its lower end, as viewed in FIGS. 6 and 7. A spiral or helical fin 12 is wound substantially along the length of the hollow tubular body 10, as shown most clearly in FIGS. 6 and 7. The helical fin 12 is widest at its base, where it contacts the outer periphery of the body portion 10 and tapers to a point, as viewed most clearly in FIG. 7. The tapered nature of the helical fin 12 facilitates the winding of hair into the grooves or spaces between adjacent turns of the spiral 12, and further facilitates the removal of hair from the spiral designer curler of FIGS. 6 and 7. The portion of the body 10 between the flange 11 and the lowermost spiral fin 12 is of greater diameter than the portions between adjacent turns of the spiral 12.

Figure 7:
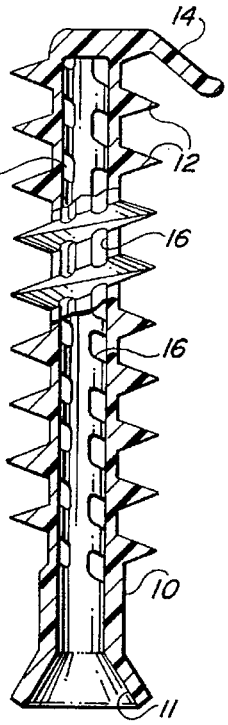
FIG. 7 is a cross-sectional view taken along the line 7—7 of FIG. 6.
Figure 8:
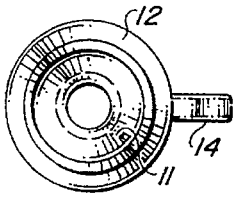
FIG. 8 is a bottom view of the device shown in FIG. 6.
Figure 9:
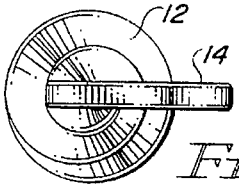
FIG. 9 is a top view of the device shown in FIG. 6.

The upper end of the curler is closed, as shown most clearly in FIG. 7; and an extension 14 is integrally formed as part of the spiral designer tool of these figures to extend substantially radially outwardly from the closed end to a distance beyond the distance to which the tips of the helical fin 12 extend.

As shown most clearly in FIG. 7, a plurality of air slots 16 are formed through the tubular body portion 10 between adjacent turns of the helical or spiral fin 12 and extending a short distance into the fins 12. These slots or apertures 16 extend throughout the length of the spiral designer tool and are located at spaced intervals around the periphery of it.

Figure 16:
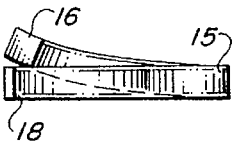
FIG. 16 is a side view of clip used in conjunction with the embodiment shown in FIG. 6.

When the tool of FIGS. 6 through 9 and 16, 17 and 19 is used, strands of hair are wound between the adjacent turns of the helical fin 12, with curling taking place on any part of the hair shaft, from the ends only or all the way to the scalp. Even portions in between the ends and the scalp may be individually wound and curled to produce different designs. The extension 14 is located adjacent the scalp and serves to anchor the tool of FIGS. 6 through 9, 16, 17 and 19, against turning after the hair has been wound on the tool. As shown in FIG. 16, a spring clip 15 having a pair of offset legs 16 and 18 is used to clamp the ends of the hair wound around the tool body portion 10 at any desired point along the length of the tool. The clip 15 may be placed on the body portion 10 of the tool at any location and then can be wound along the spiral 12 to seal the hair ends to the body 10 to prevent fuzzy ends.

Depending on the wrap used on the spiral designer tool of FIGS. 6 through 9, large, loose hanging curls to tight, firm spiral curls may be formed. When more hair is wound on the rod, larger, looser curls are produced. When less hair is wound, tighter, springier curls are created. Tight curls can be created by twisting the hair sections while wrapping them around the rod between the adjacent turns of the spiral; and different amounts of twisting while wrapping around the rod create a variety of different types of curls. It should be noted that by providing the hook or extension 14 on the upper end of the rod, the hair may be wrapped onto the rod between the spirals-from the top down; or it can be started anywhere and end anywhere on the rod to create the various styles desired by an individual stylist. As noted previously, the tapered wall of the helical fins 12 facilitates easy winding and unwinding of the hair.

The spiral designer curler rod shown in FIGS. 6 through 9, 16, 17 and 19 typically is provided in sets of different diameters with a typical length of 6½ inches. The center diameters of the tubular body portion 10 typically are provided in sets of ⅜ inch to 1 inch diameters at 1/16 inch graduations. This means that there are typically eleven rod sizes or curler sizes in each set. By providing the tool in these various sizes, a hair stylist, having a set of such tools, is given substantial flexibility to create a wide variety of hair styles.

For use in conjunction with the hair curler rod described thus far, an adapter or coupler 22 is provided for the hand-held hair dryer 20 shown in FIG. 1. The adapter includes a first hollow tubular portion 24, which has an internal diameter selected to fit over the end of the hair dryer 20 as shown in FIG. 1. The end of the nozzle of the hair dryer 20 abuts a shoulder on the inside of the portion 24 of the coupler 22. This shoulder is shown most clearly in FIG. 3. As illustrated in FIGS. 1 through 5, the coupler 22 has a smaller concentric tubular section 30, which is attached to the larger outer section 24/26 by means of four angled support vanes or spacers 34, as shown most clearly in FIGS. 4 and 5. The center of the smaller tubular section 20 has a hollow cylindrical bore 36 formed through it; and the end is tapered in a conical taper 32, as illustrated most clearly in FIGS. 1, 2 and 3.

When the coupler 22 is mounted on the end of a dryer 20, air from the dryer passes out in a compressed directed airflow through the apertures between the support spacers 34, which impart a spiral air flow over the outside of the tubular section 30. Air also passes through the opening 36 in the section 30, as is readily apparent from an examination of FIGS. 1 and 3.

Figure 19:
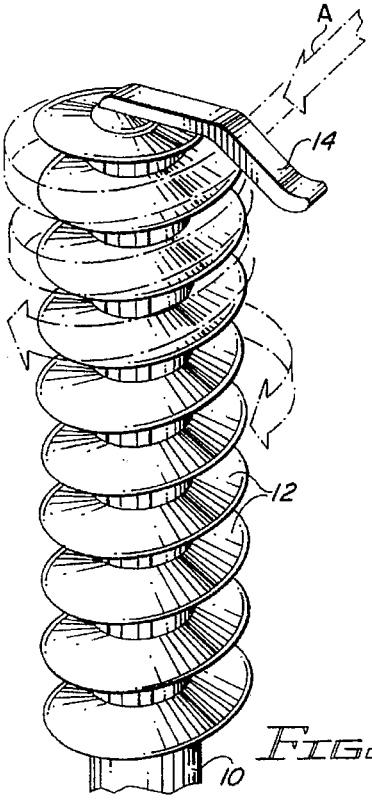
FIG. 19 is a perspective view illustrating the manner in which hair is wound on the device of FIG. 6.
Figure 18:
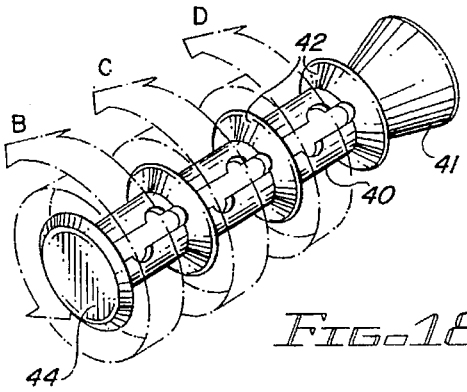
FIG. 18 is a perspective view illustrating the manner in which hair is wound on the device of FIG. 10.

After wet hair (either with or without styling solutions applied to it) is wound on the spiral designer curler of FIGS. 6 through 9 in the manner illustrated in FIG. 19, the dryer 20, with the coupler 22 attached to it is located to insert the conically tapered section 32 on the end of the coupler 22 into the flange 11 at the bottom of the spiral designer curling rod. When the dryer 20 is turned on, air flows through the bore 36 into the interior of the tubular body portion 10 of the rod and outwardly through the apertures 16 and through the hair wound on the rod. At the same time, directed heated air passes over the outside of the rod 10–16 to create a twisting vortex air current, which draws in surrounding air over the outside of the hair. When the inside and outside air currents meet, they cause a convection effect to increase the drying of the hair; and drying is accomplished in a uniform manner throughout the hair which is wound on the tool.

FIGS. 10, 11, 12, 13 and 18 disclose a different configuration of a curler or curling rod in the form of a volume designer for providing larger bulk-type curls for a different styling effect than is accomplished by the curling rod of FIGS. 6 through 9. The curling rod shown most clearly in FIGS. 10, 11 and 12 comprises an elongated hollow tubular body portion 40, which is comparable to the body portion 10 of the rod shown in FIG. 6. The lower open end of the body portion 40 has an outwardly flared flange 41 attached to it. The upper end 44 is closed and extends radially outwardly from the end of the rod, as shown most clearly in FIGS. 11 and 12.

Figure 10:
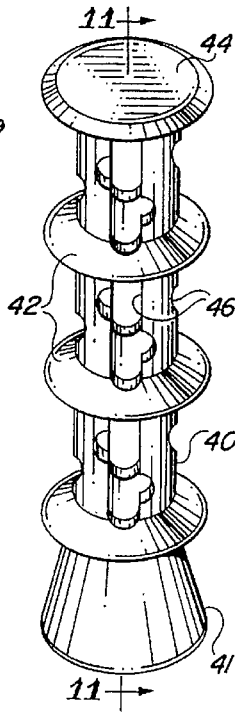
FIG. 10 is a perspective view of another variation of a rod used in the preferred embodiment of the invention.
Figure 11:
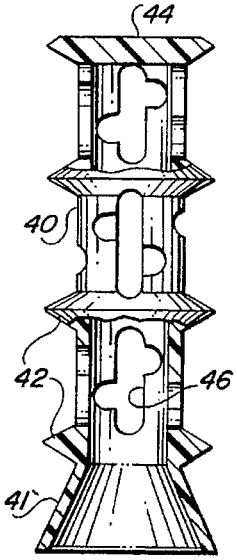
FIG. 11 is a cross-sectional view of the rod shown in FIG. 10.
Figure 12:
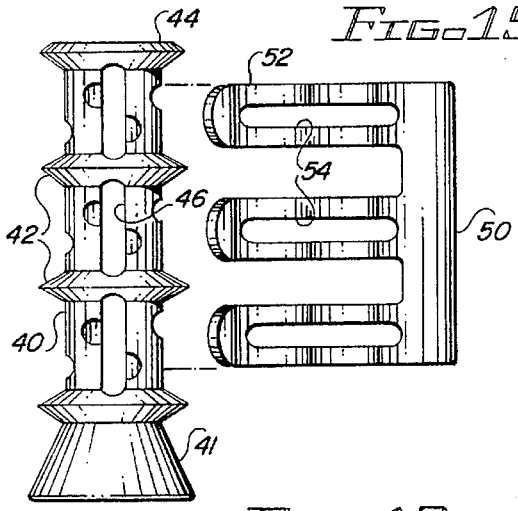
FIG. 12 is a side view of the device shown in FIG. 10 illustrating a clip used with such device.

As shown in FIGS. 10, 11 and 12, three spaced circular fins 42 extend radially outwardly from the body portion 40. These fins are tapered; so that they have decreasing thickness as the radial distance outward from the body portion 40 increases. The cross-sectional configuration of the fins 42 is comparable to the cross-sectional configuration of the helical fin 12 described above in conjunction with the embodiment of FIG. 6 through 9.

Elongated slots 46 are provided between each of the sets of fins 42, and these slots are located at 90° spaced intervals about the periphery of the body portion 40. The purpose of the slots 46 is the same as the purpose of the slots 16 in the device of FIGS. 6 through 9; and the coupler 22 used in conjunction with the hair dryer 20 provides the same drying effect for the volume designer curler of FIGS. 10 and 11 as is provided by the dryer and coupler described above in conjunction with the embodiment of FIGS. 6 through 9.

Figure 13:
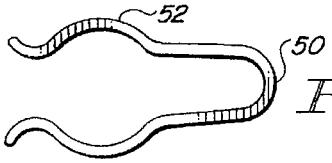
FIG. 13 is an end view of the clip shown in FIG. 12.
Figure 17:
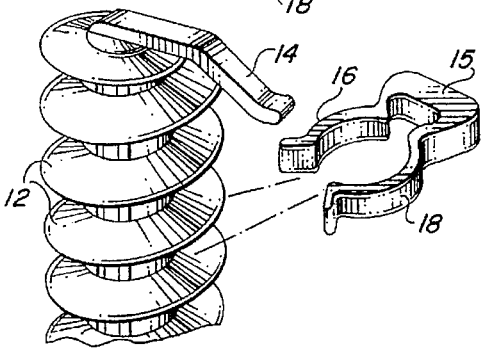
FIG. 17 is an exploded view showing the manner of use of the clip shown in FIG. 16 with the device of FIG. 6.

FIGS. 12 and 13 show the type of clip 50 which is used to hold hair in the spaces between adjacent fins 42 of the volume designer curler of FIGS. 10 through 12. As is shown in FIG. 12, the designer has three flat areas between adjacent sets of fins 42; so that the clip has three sets of spaced apart legs 52 on it. Each of the legs 52 has an elongated slot 54 formed through it; so that air passing outwardly from the slots 46 in the designer 40–44 also passes outwardly through the slots 54 in the holding clip 50.

The arrangement and spacing of the circular fins 42 allows the stylist to create multiple curls from one rod, instead of one single curl. Because of the configuration of the volume designer and clip of FIGS. 10, 11 and 12, it can be used to curl any part of the hair shaft from the ends only to all the way to the scalp and any portions in between. The clips and rods create multiple individual curls, instead of one large looping curl. Again, more hair on the rod creates looser body curls. Less hair on the rod creates tighter, bouncier curls. Once the hair has been dried as described above, and the rod 40–44 is removed, the individual curls which are formed on it may be left as individual curls; or they may be blended together by brushing them into larger single curls.

The slots 46 in the body portion 40, along with the slots 54 in the clip 50/52, permit rapid drying by allowing moisture to drain from the hair and to permit air from the dryer 20 to pass outwardly through the slots 46 and 54 and through the hair, while the turbo effect effected by the spacers 34 in the coupler 22 facilitates drying from the outside as well.

The volume designer curling rod of FIGS. 10 through 12 also is produced with different center diameters for producing different effects, as desired. Typically, the center diameters vary from ⅜ inch to ⅛ inch diameter in 1/16 inch graduations, as with the spiral rods of FIGS. 6 through 9 described above.

Figure 14:
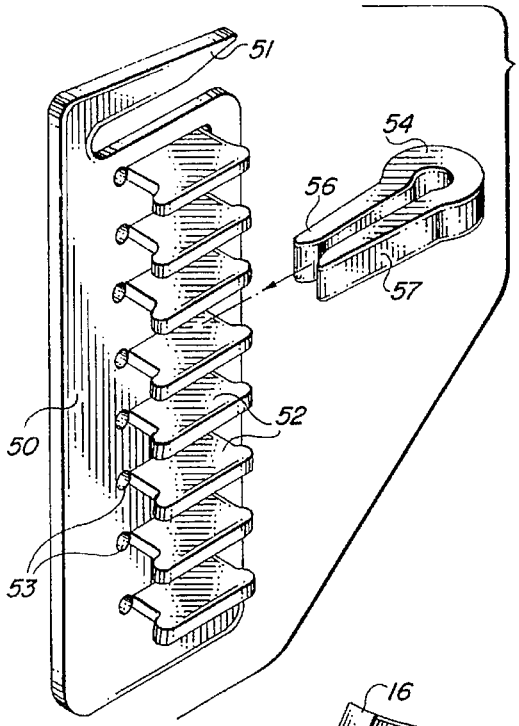
FIG. 14 is a perspective exploded view of another rod and clip used in a preferred embodiment of the invention.
Figure 15:
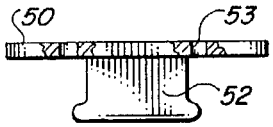
FIG. 15 is an end view of a portion of the device shown in FIG. 14.

FIGS. 14 and 15 are directed to a designer curling rod having a different configuration. The rod of these figures may be considered as a creative designer. It comprises an elongated rectangular plate 50, with a hook 51 in its upper end. Extending outwardly from inside the plate 50 are a number of projections 52, which are slightly wider at their outer end than at the base end attached to the plate 50. Drain holes 53 pass through the plate 50 at each end of each of the projections 52. A variety of styling designs and curls may be created with the creative designer 50–52. These designs include forming "Z" curls, reverse loop curls, figure 8 curls, and large, soft waves of the type previously made with juice cans or large diameter cylinders. In addition, multiple variations of each of these may be produced with the creative designer tool of FIGS. 14 and 15.

The tools or rods described above also facilitate color highlighting, since they do not require painful frosting caps, tin foil, or foil weaves and the like. With the rods which have been described above, chemical solutions (color or permanent solutions) may be applied to any portion of the hair shaft to enable a stylist to avoid placing chemicals over hair which previously has been chemically treated (either by color or permanent solution). With the creative designer rod of FIGS. 14 and 15, color treated hair is wound around the projections 52 lying-against the flat part at the base 50 of the rod. This permits the stylist to view the color as it is processing. When multiple rods of the type shown in FIGS. 14 and 15, as well as the rods of the other figures, are used, the raised projections 52 of the rods of FIGS. 14 and 15, or the spiral projection 12 of the rods of FIGS. 6 and 7, or the rings 42 of the rod of FIGS. 10 and 11, cause the next adjacent overlapping rod to be held up and away from the treated hair on the bottom rod. Consequently, the rods used in the system separate the hair which is wound on each of the rods from hair wound on other adjacent rods.

Ideally, all of the rods and the coupler 22, which have been described in conjunction with FIGS. 1 through 19, are made of plastic material which is inert to the chemicals used in permanent wave, color and styling solutions, and which is capable of withstanding the heat temperatures of the heated forced air from conventional hand-held hair dryers. Typically, such temperatures (on medium and low settings) are on the order of 200° Fahrenheit or less. The reduced apertures, such as the aperture 36 used in the coupler 22, restrict air flow from the dryer 20 and produce warmer air from a medium temperature or low temperature setting. This significantly reduces the potential for heat related hair damage from use of the system. A variety of commercially available plastics are presently available and are suitable for these purposes.

It should be noted that all of the designer rods or curler rods which are disclosed in FIG. 6 through 19 permit styling, restyling, and perming on the same rod. In addition, the creative designer of FIGS. 14 and 15 is suitable for color highlighting, replacing the need for painful frosting caps, tin foil or foil weaves. One of the advantages of the various styling rods used with the system is that the rods may be used for a preview of a hairstyle before a commitment to that style through a permanent wave. The same stylers are used for daily set or for perming. In addition, the system has the ability to style wet, damp or dry hair. The hair may be natural air dried or blown dry in conjunction with the coupler 22 described above. In addition, the system cuts the time for permanent wrapping by approximately two-thirds over the time required for a permanent using conventional perm rods and techniques, and also permits perming of regrowth hair only.

The apertures 16 in the curler rods of FIGS. 6 through 9, the apertures 46 in the curler rods of FIGS. 10 through 12, and the apertures 53 in the rod of FIGS. 14 and 15 allow excess moisture to drain out of the hair and into the inside of the rods. A permanent wave can be produced without requiring perm papers; and it is not necessary to use any rubber bands, such as the ones on conventional perm rods. Such bands create band marks that cause breakage of the hair. Elimination of the bands eliminates this potential problem.

The foregoing description of the preferred embodiment of the invention is to be considered as illustrative and not as limiting. Various changes and modifications will occur to those skilled in the art for performing substantially the same function, in substantially the same way, to achieve substantially the same result, without departing from the true scope of the invention as defined in the appended claims.

What is claimed is:

1. A kit for a hair styling system for use with a forced air hair dryer including in combination:

a coupling member having a first end with internal dimensions selected to fit over the end of a forced air electric hair dryer and having a concentric smaller hollow tubular section mounted in said first end by means of spacers with apertures therebetween to permit air flow over the outer periphery of said smaller tubular section, said smaller hollow tubular section extending beyond said first end and terminating in a coupling portion;

at least a first elongated hollow tubular body with first and second ends, said body being open at the first end thereof and closed at the second end thereof, with said first end configured to matingly couple with said smaller tubular section of said coupling member, said hollow tubular body having spaced apertures therethrough at predetermined intervals along the length thereof and about the periphery thereof.

2. The kit according to claim 1 wherein said smaller tubular section of said coupling member terminates in a tapered nozzle; and further including a nozzle receiving flange on said first end of said tubular body for receiving said nozzle of said coupling member.

3. A kit according to claim 2 wherein said spacers for supporting said smaller tubular section within said end of said coupling member are angled to create a spiral twist to air movement therethrough from a forced air hair dryer.

4. The kit of claim 3 further including spaced fins extending radially outwardly from said hollow tubular body.

5. The kit according to claim 4 wherein said spaced fins have a tapered cross section, decreasing in thickness at increasing radial distances from said tubular body.

6. The kit according to claim 5 wherein said spaced fins comprise at least first and second spaced circular fins extending radially outwardly from said tubular body.

7. The kit according to claim 5 wherein said spaced fins comprise a helical fin member on said elongated hollow tubular body extending radially outwardly therefrom along the length of said body.

8. The combination according to claim 5 further including an elongated finger attached to said closed end of said tubular body and extending radially outwardly therefrom a predetermined distance.

9. The combination according to claim 8 wherein said finger extends outwardly from said hollow tubular body a distance greater than the distance said fin extends from said tubular body.

10. The combination according to claim 1 further including an elongated finger attached to said closed end of said tubular body and extending radially outwardly therefrom a predetermined distance.

11. The combination according to claim 10 wherein said finger extends outwardly from said hollow tubular body a distance greater than the distance said fin extends from said tubular body.

12. A kit according to claim 1 wherein said spacers for supporting said smaller tubular section within said end of said coupling member are angled to create a spiral twist to air movement therethrough from a forced air hair dryer.

13. The kit of claim 1 further including spaced fins extending radially outwardly from said hollow tubular body.

14. The kit according to claim 13 wherein said spaced fins have a tapered cross section, decreasing in thickness at increasing radial distances from said tubular body.

15. The kit according to claim 14 wherein said spaced fins comprise at least first and second spaced circular fins extending radially outwardly from said tubular body.

16. The kit according to claim 14 wherein said spaced fins comprise a helical fin member on said elongated hollow tubular body extending radially outwardly therefrom along the length of said body.

17. The kit according to claim 1 wherein said first elongated hollow tubular body has at least first and second spaced circular fins extending radially outwardly from said tubular body; and further including a second elongated hollow tubular body with first and second ends, said second body being open at the first end and closed at the second end thereof, with spaced apertures therethrough at predetermined intervals along the length thereof and about the periphery thereof, said second body having a helical fin extending radially outwardly therefrom along the length of said second body.

18. The kit according to claim 17 wherein said first and second spaced circular fins and said helical fin are tapered in cross section, decreasing in thickness at increasing radial distances from said first and second tubular bodies.

19. The kit according to claim 18 further including resilient clip members dimensioned to fit over hair wrapped around said hollow tubular body for pressing said hair in place against said body.

20. A kit according to claim 19 wherein said spacers for supporting said smaller tubular section within said end of said coupling member are angled to create a spiral twist to air movement therethrough from a forced air hair dryer.

21. The kit according to claim 17 further including resilient clip members dimensioned to fit over hair wrapped around said hollow tubular body for pressing said hair in place against said body and further including a flat body member with spaced flat projections extending therefrom.

* * * * *